United States Patent [19]

Pilette et al.

[11] Patent Number: 4,465,283

[45] Date of Patent: Aug. 14, 1984

[54] MAZE TYPE GAME BOARD WITH ALTERNATELY COLORED SPACES

[76] Inventors: Deborah L. Pilette, 19700 Greenwald Dr., Southfield, Mich. 48075; Paula D. Romund, 26266 Evelyn Ct., Franklin, Mich. 48025

[21] Appl. No.: 378,822

[22] Filed: May 17, 1982

[51] Int. Cl.[3] ..... A63F 3/00

[52] U.S. Cl. ..... 273/249

[58] Field of Search ..... 273/248, 249, 250, 251, 273/252, 258, 275, 153 R, 284; D21/14, 15, 24, 33, 34, 35

[56] References Cited

U.S. PATENT DOCUMENTS

| | | | |
|---|---|---|---|
| 984,302 | 2/1911 | Rosenberger | 273/153 R |
| 1,480,360 | 1/1924 | Agee | 273/249 |
| 2,806,703 | 9/1957 | Friedkin | 273/249 |
| 4,029,320 | 6/1977 | Hausman | 273/249 |

FOREIGN PATENT DOCUMENTS

| | | | |
|---|---|---|---|
| 206530 | 8/1956 | Australia | 273/249 |
| 1042543 | 11/1953 | France | 273/249 |
| 1567639 | 5/1980 | United Kingdom | 273/243 |

*Primary Examiner*—Richard C. Pinkham
*Assistant Examiner*—Matthew L. Schneider
*Attorney, Agent, or Firm*—Rummler & Snow

[57] ABSTRACT

This invention concerns a game board apparatus comprising a checkerboard pattern of a multiplicity of parallel rows and columns of alternately-colored spaces and a pair of continuous pathways running horizontally and vertically from space-to-space in opposite directions by devious routes from one corner of the board to a diagonally-opposite corner of the board, and means providing a maze of several alternative and dead-end paths deviating from each pathway and designed to confuse the players with respect to the most direct route for movement of a play piece from start to finish of each pathway, the rate of a player's play piece progess from start to finish being determined entirely by chance and player perception.

1 Claim, 5 Drawing Figures

MAZE TYPE GAME BOARD WITH ALTERNATELY COLORED SPACES

BACKGROUND OF THE INVENTION

This game was developed primarily as a game of skill and chance, the skill being an exercise of the player's perception in the selection of a suitable path from a maze of paths for movement of a play piece from a starting place to a finish place during play of the game. It was intended that this game be structured to interest players in the age levels of eight to adult and particularly to provide a stimulating experience and foster interest that would make a parent more apt to happily sit down with his child to play a game.

With these objects in mind, we sought to design a maze game with unusual and confusing design features that would make it very difficult for a person to memorize the correct path through a maze of paths for movement of his play piece from start to finish and this, we believe we have accomplished.

SUMMARY OF THE INVENTION

This game was developed to utilize the skill of the player as it may be affected by chance. It is basically a maze design covering the total area of a checkerboard pattern game board having a very large number of both rows and columns of spaces of uniform size. In the form shown, there are twenty-four rows and twenty-four columns. This checkerboard playing field has a number of squares marked off at each of two diametrically-opposite corners of the checkerboard field, each of these spaces preferably comprising six spaces, to serve respectively as "Start" and "Finish" zones for receiving each player's play piece. Additionally, a square area in the middle of the checkerboard field is marked off as a neutral area for the reception of playing cards or other means, the use of which is determined by chance, designed to affect the play of each player during the course of the game. These means deposited in the neutral area may comprise two kinds of directions, one of which is advantageous and the other of which serves as a penalizing factor. Also, on each side of the square neutral area, a pair of openings are provided to communicate with a contiguous row or column for game purposes.

Onto this checkerboard field, which is made unique by the arrangement of color applied to alternate spaces in the rows and columns of spaces comprising the playing field so as to impart diagonal rows of color, a maze pattern is set up to run in a horizontal and vertical arrangement across the diagonal pattern of colored spaces. This kind of arrangement makes it very difficult for a person to memorize the maze paths, of which there are two principal pathways, one running counterclockwise from start to finish and the other running clockwise from start to finish. Each of these pathways is continuous from start to finish and runs in a very irregular and devious manner both vertically and horizontally over the checkerboard pattern of the playing field and each of these principal pathways from start to finish of the playing field is delineated by an arrangement of fences which more-or-less give a clue to the direction in which the principal pathways run. Additionally, these fences have direction and openings which lead to devious and deadend passages of various lengths which function as diversions designed to impede the forward progress of each player's play piece toward the finish zone.

Various means are randomly scattered over the checkerboard playing field to function in one way or another to either enhance or impede the progress of a player's playing piece, and in any case, the number of spaces over which a playing piece may be moved is determined solely by the operation of a spinner, a die, or any other suitable means for designating a number by chance which determines for the player the number of spaces over which he may move his playing piece during his turn to play.

Since the principal markings on the board concerning the direction in which a player may move his playing piece comprise the pattern of fences that overlie the checkerboard playing field, the player must study the board before each play and then make his move as determined by the chance number of spaces allowed for the move and the fences that he will encounter as he moves his piece, the fences being actual barriers through or over which a player may not move.

With the unique design of this playing board, the average person is not capable of perceiving the entire maze pattern in one overall glance. A player may, after having studied the board, be able to visually get through the maze; however, he would not be able to remember from where he came. Only a section of the maze can be figured out at one time and because of this limitation in perception, this game will continue to stimulate the thought perception process of the players. However, no matter how a player might plan, the various indicators arbitrarily scattered over the field will act as deterrents to any planned strategy of play. These deterrents may cause a player to go forward or backward or to even lose a turn and they are encountered strictly by chance. A unique feature of this board game resides in the diagonal lines running across the playing field and resulting from the checkerboard coloring of the rows and columns of the playing field spaces and the combination therewith of two unmarked paths running continuously in devious and irregular directions from the start position to the finish position across the checkerboard playing field.

DESCRIPTION OF THE DRAWINGS

A specific embodiment of this invention is illustrated by the accompanying drawings, in which.

DESCRIPTION OF A SPECIFIC EMBODIMENT OF THE INVENTION SHOWN IN THE DRAWINGS

Figure 2:
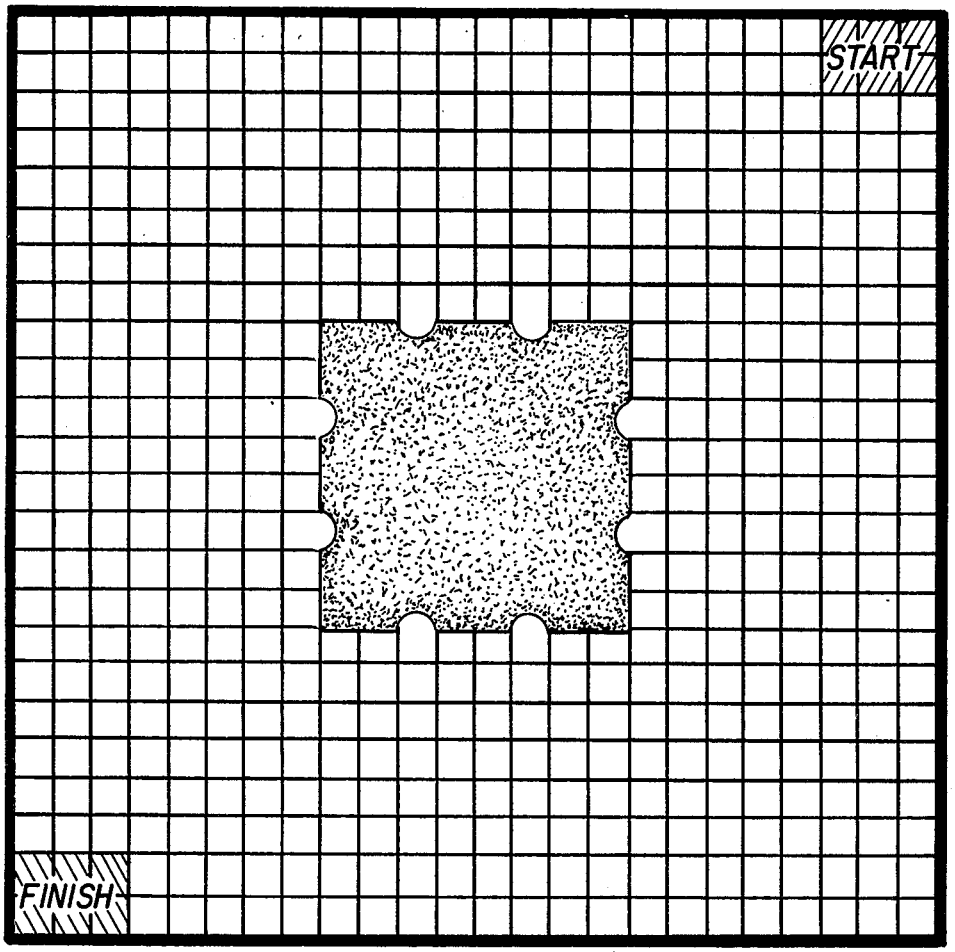
FIG. 2 is a view showing the basic gameboard having a playing area comprising a pattern of rows and columns of contiguous spaces and having a certain area marked out of the playing field for game purposes.

The manner of constructing a gameboard embodying the intricate maze system of our invention is substantially illustrated by the accompanying drawings. In the form shown, the gameboard 10 is first laid out, preferably in a square pattern of twenty-four rows and an equal number of columns of playing spaces 12 of uniform size. Then, as shown in FIG. 2, a rectangular central area 14 of sixty-four spaces is marked off to serve as a neutral zone in which various means may be deposited for chance direction for the play of the game; and at each of the two diagonally-opposite corners of the board a start zone 16 and a finish zone 18, respectively, is marked off.

Figure 3:
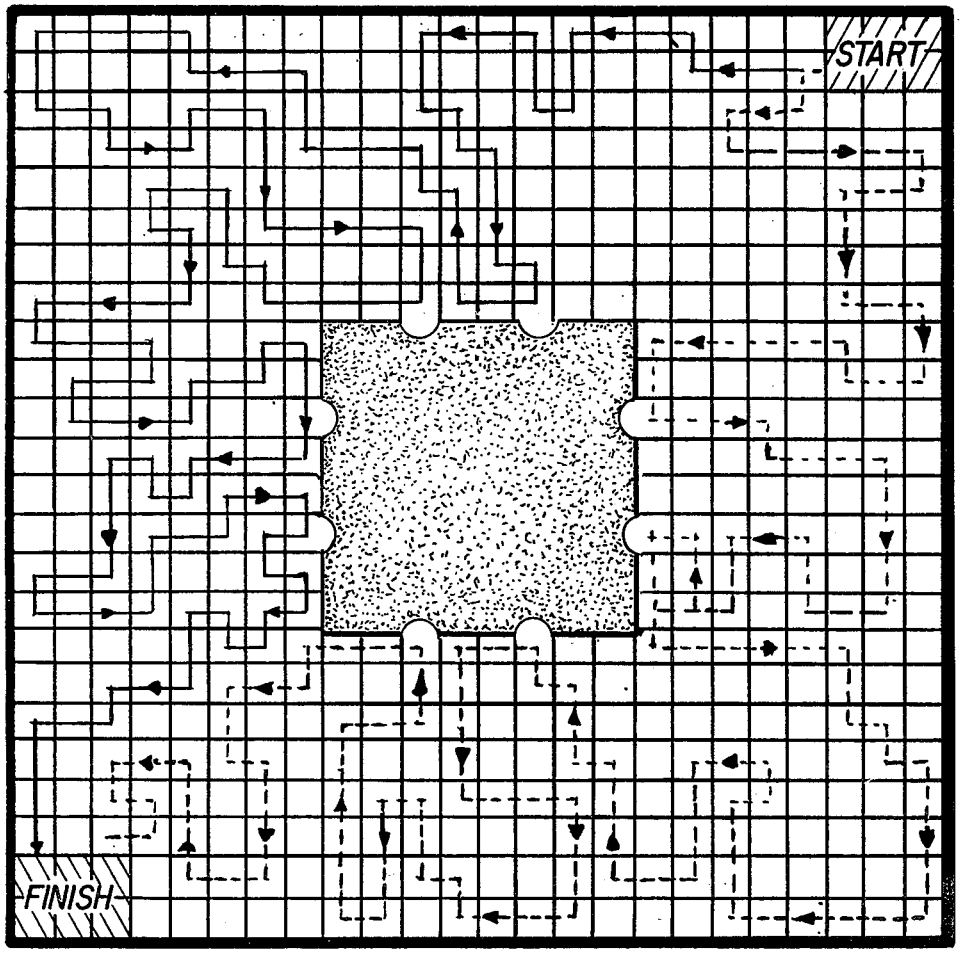
FIG. 3 is a view of the same showing the application of two arbitrary pathways over the gameboard spaces, each being differently marked to keep the pathways separate during construction of the gameboard, the pathways being marked in a removable manner.
Figure 4:
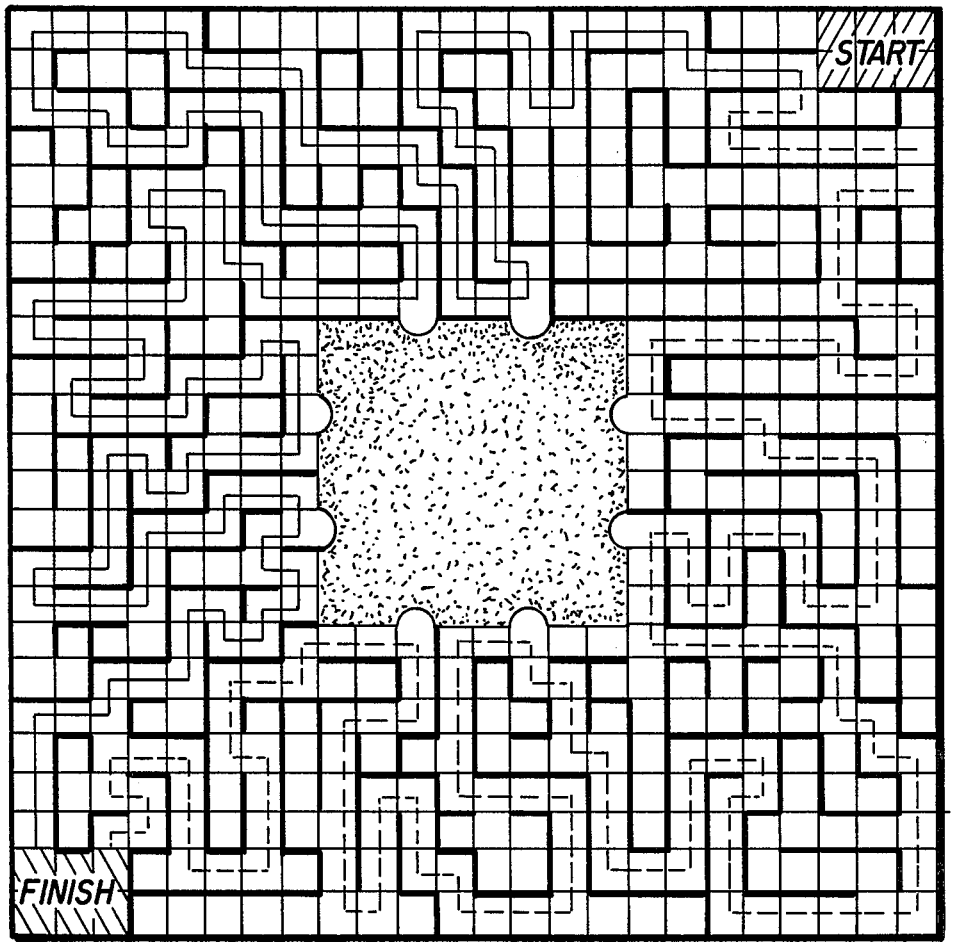
FIG. 4 illustrates the selected application of barriers or fences onto the pathway design of FIG. 3 for controlling the main pathways and simultaneously creating diverting and deadend routes.

Next, as shown in FIG. 3, the plan for each of the two principal pathways is individually devised and temporarily marked on the playing area in a removable manner, each being more-or-less arbitrarily designed but including substantially the same number of spaces. Then the pattern of fences 20, which create the maze of paths over which a playing piece may be moved, is designed and permanently marked along the lines forming the rows and columns of spaces. When the pattern of fences is completed, the pathways markings are removed leaving only the playing field with the marked-off areas 14, 16 and 18 and the pattern of fences 20 as shown in FIG. 4.

Figure 5:
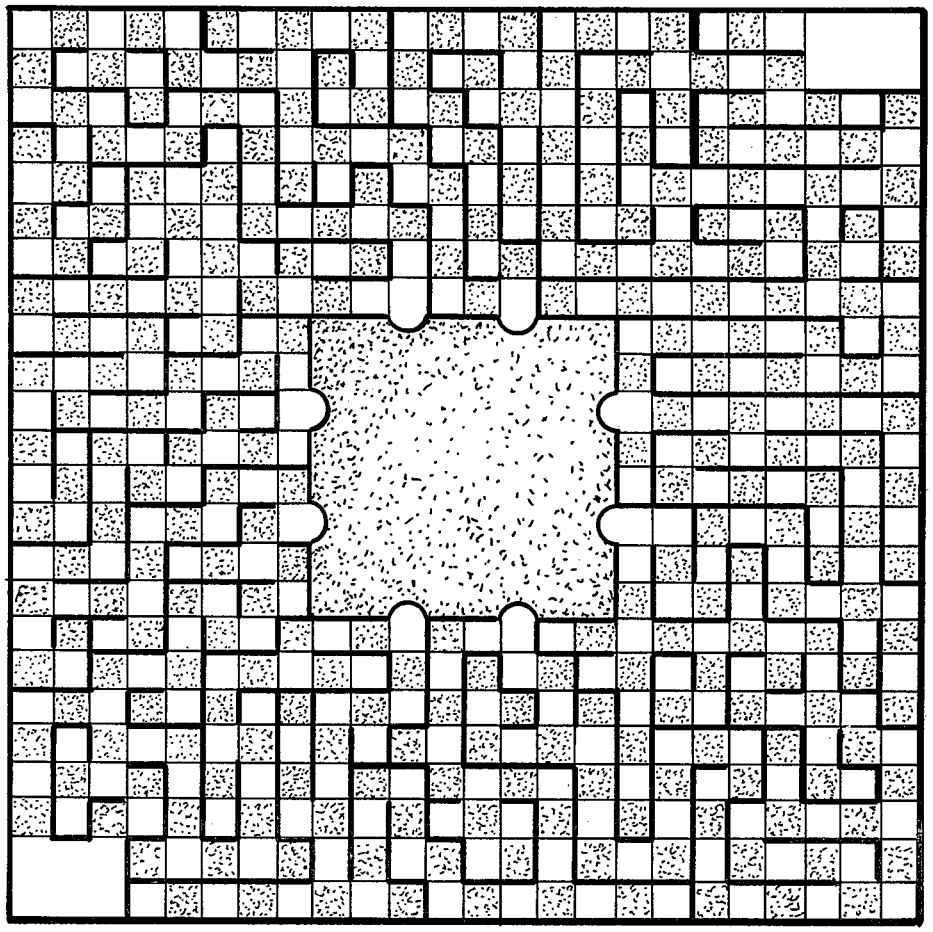
FIG. 5 is a view of the gameboard as in FIG. 2 showing only the pattern of the fences applied to the playing surface to designate various play piece paths, the temporary pathway markings having been removed, and the application of a color to alternate spaces in each direction across the board to create the checkerboard pattern of FIG. 1.

FIG. 5 illustrates the application of color to the alternate spaces of the columns and rows of spaces so as to form the checkerboard appearance of the playing field. This adds confusion to the play of the game, as well as to attempts to memorize the true pathway directions from the start to finish zones.

The foregoing describes the construction of the basic gameboard of our invention and onto this basic board, other markings may be applied to function in any desired manner to affect the play of the game. This is illustrated by the various markings of color and indicia shown on the complete gameboard shown in FIG. 1. One arrangement we like is to provide two sets of game cards, one set 22, designated "Risk", being various penalty directions and the other set 24, designated "Run", being direction of advantage. These cards are placed in the neutral area 14 and each set is denoted by a particular indicia 26 and 28, respectively. A player landing on a space having one of these indicia must select a corresponding card and then follow the play movements directed by the card before his turn at game play is finished.

Figure 1:
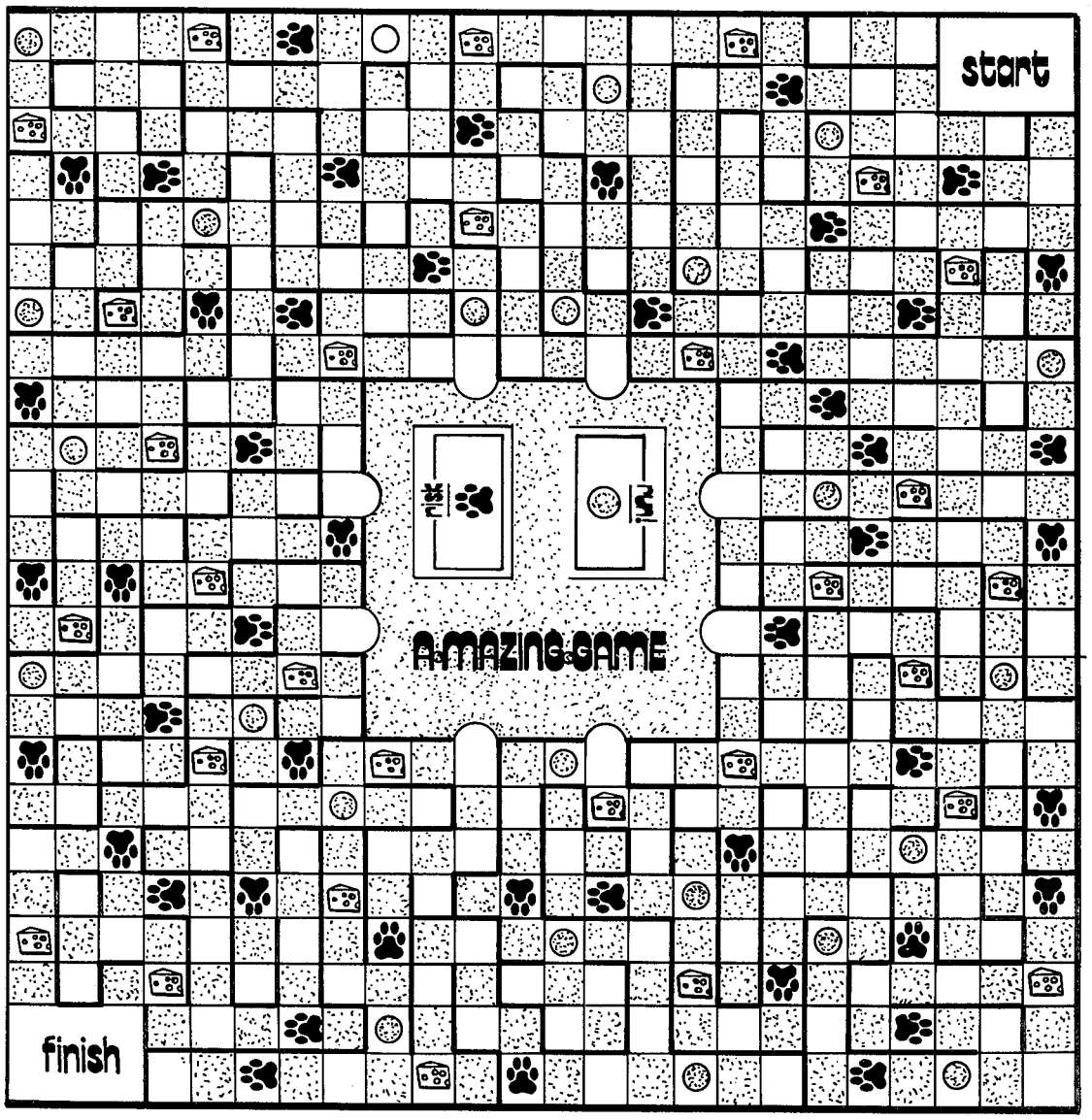
FIG. 1 is a full color rendition of an arbitrarily-designed complete gameboard according to our invention.

In the play of the game, each player is provided with a play piece which is moved from space-to-space on the playing field with the object of following an assigned path from start to finish as directly as possible. The number of spaces over which the playing piece is to be moved during each play is preferably determined by chance through the use of a suitable spinner or die, or any other means for determining an arbitrary number. The choice of direction for the player to move his play piece is strictly a matter of judgment and it is in that regard that the player's perception is probably the key factor to success in the game. To further complicate the play of the game, various additional means can be applied to various arbitrarily selected spaces over which a player may move his play piece, such as particular marks indicating a gain or a penalty, or the application of colors or symbols directing variations of play. An example of such markings and symbols is shown in FIG. 1, which illustrates a complete gameboard ready for play.

The object of the game is for the first player to complete the maze to the section marked "Finish" to win the game.

At the beginning, each player places a colored playing piece in the section marked "Start" and each person then operates the chance means for designating a number and the player rolling the highest number begins the game. The number one player then operates the chance device and moves his play piece the number of spaces indicated.

In this regard, the rules of the game may be as follows:

(a) A player may only move backward when he entered a deadend path, has hit the wall and is moving in another direction toward the finish space.

(b) When the player draws a "Risk" or "Run" card in play, he must follow the card directions before his play turn ends.

(c) When a player has drawn a number larger by chance than the spaces he has remaining to enter the finish area, he must pass his turn and await the time when his chance number is the same or less than the number of spaces remaining in his path. He must ultimately have a chance number exactly the same as the remaining spaces in his path.

(d) A player may not move diagonally and must go around the walls or fences and not through or over them.

(e) Each player should devise his strategy of play before operating the chance number device. Once the chance number operation has begun, the player must move quickly as directed (within about thirty seconds) or forfeit his turn.

(f) Once a move has been made onto a space, the player cannot change his mind but rather must continue in the direction he has originally headed for the full count of his number.

(g) When a player realizes that he has taken a wrong path and is nearing a deadend, he must complete the path, hit the wall and then backtrack to a safer route. He may only backtrack the amount of spaces left in the number of his play. If a player does not reach the wall in his turn, he must wait until his next turn to reach the wall and then move backward.

(h) If a player lands on a space occupied by the play piece of another player, he may share that space without penalty.

(i) A player may not cross the finish line until he obtains by chance the exact number as he has spaces remaining in his path.

(j) If a player is only a few spaces away from the finish line and his chance number is larger than the spaces remaining in his move, he must backtrack the chance number obtained for this move.

Although but one specific embodiment of this invention has been herein shown and described, it will be understood that numerous details of the invention disclosed may be altered or omitted without departing from the spirit of the invention as defined by the following claims.

We claim:

1. A game apparatus for a plurality of players comprising, (a) a playing board having a rectangular playing surface defined by a grid comprising contiguous parallel rows of spaces of uniform size extending laterally toward the sides of the playing surface, and said rows being of sufficient number to provide columns of spaces extending to the top and to the bottom edges of said playing surface, the alternate spaces of each row being distinctively colored to create a checkerboard pattern of alternately distinctive diagonal rows of spaces extending across said playing surface, (b) means at each of two of the opposite corners of said grid marked to define the start and finish areas for a pair of individual pathways running from space-to-space across opposite side areas of said grid from the start area to the finish area, (c) individual barrier lines arbitrarily applied to said grid between the spaces thereof and serving to define a maze for each of said pathways, each maze including the respective pathway and a plurality of branching and dead-end passages deviating therefrom at a plurality of arbitrary locations between the respective start and finish area, (d) means defining a rectangular closed area in the center of said grid barred from said rows and columns of spaces except for a pair of openings on each side leading to a contiguous row or column of spaces and communicating with the next adjacent one of said pathways, (e) separately identified and individual means in said closed area for directing favorable and unfavorable play actions, (f) randomly distributed indicia in said pathways designating favorable and unfavorable play action means to be taken by a player from the said closed area, (g) a plurality of individual playing pieces each movable from space-to-space to designate a respective player's position on said grid, and (h) chance means for determining the number of spaces over which a player may move his playing piece in attempting to advance the playing piece from the start area to the finish area.

* * * * *